US009528224B2

(12) United States Patent
Widlroither

(10) Patent No.: US 9,528,224 B2
(45) Date of Patent: Dec. 27, 2016

(54) MANUALLY DISPLACEABLE MACHINE FOR MAINTAINING A TRACK

(71) Applicant: ROBEL BAHNBAUMASCHINEN GMBH, Freilassing (DE)

(72) Inventor: Otto Widlroither, Freilassing (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 209 days.

(21) Appl. No.: 14/420,033

(22) PCT Filed: Jul. 25, 2013

(86) PCT No.: PCT/EP2013/002212
§ 371 (c)(1),
(2) Date: Feb. 6, 2015

(87) PCT Pub. No.: WO2014/026729
PCT Pub. Date: Feb. 20, 2014

(65) Prior Publication Data

US 2015/0225904 A1 Aug. 13, 2015

(30) Foreign Application Priority Data

Aug. 16, 2012 (DE) ..... 20 2012 007 818 U

(51) Int. Cl.
*E01B 29/24* (2006.01)
*E01B 29/32* (2006.01)

(52) U.S. Cl.
CPC ..... *E01B 29/24* (2013.01); *E01B 29/32* (2013.01)

(58) Field of Classification Search
CPC ..... E01B 29/24; E01B 29/32
USPC ..... 104/13, 14, 17.2
See application file for complete search history.

(56) References Cited

U.S. PATENT DOCUMENTS

| | | | | |
|---|---|---|---|---|
| 2,552,655 | A * | 5/1951 | Talboys | E01B 29/24 81/57.25 |
| 2,607,251 | A * | 8/1952 | Talboys | E01B 29/24 476/26 |
| 3,120,193 | A * | 2/1964 | Pettigrew | E01B 29/32 104/17.2 |
| 4,068,593 | A | 1/1978 | Leeves | |
| 2006/0000382 | A1 * | 1/2006 | Widlroither | E01B 29/26 104/17.1 |

(Continued)

FOREIGN PATENT DOCUMENTS

| | | |
|---|---|---|
| DE | 1 935 427 A1 | 1/1971 |
| FR | 2 659 674 A1 | 9/1991 |

(Continued)

OTHER PUBLICATIONS

International Search Report of PCT/EP2013/002212, mailed Oct. 10, 2013.

*Primary Examiner* — Zachary Kuhfuss
(74) *Attorney, Agent, or Firm* — Collard & Roe, P.C.

(57) ABSTRACT

A motor unit (21) of a machine (1) mobile manually on a track is equipped with hand grips (27) and connected by means of a detachable coupling (20) to a work unit (12). The motor unit (21) is composed of a motor (22), a hydraulic pump (23), a hydraulic tank (24), a cooler (25), and an electric generator (26). Arranged between the motor- and work unit (21, 12) are line couplings (28) for detachable connection of hydraulic lines (29), provided for actuation of working tools (15), and of a motor control line (30).

5 Claims, 2 Drawing Sheets

(56) References Cited

U.S. PATENT DOCUMENTS

| | | | | |
|---|---|---|---|---|
| 2013/0239840 | A1* | 9/2013 | Landstrom | E01B 29/24<br>104/17.2 |

FOREIGN PATENT DOCUMENTS

| | | | | |
|---|---|---|---|---|
| SE | WO 2006031168 | A1 * | 3/2006 | E01B 29/24 |
| WO | 2006/031168 | A1 | 3/2006 | |

* cited by examiner

Fig. 1
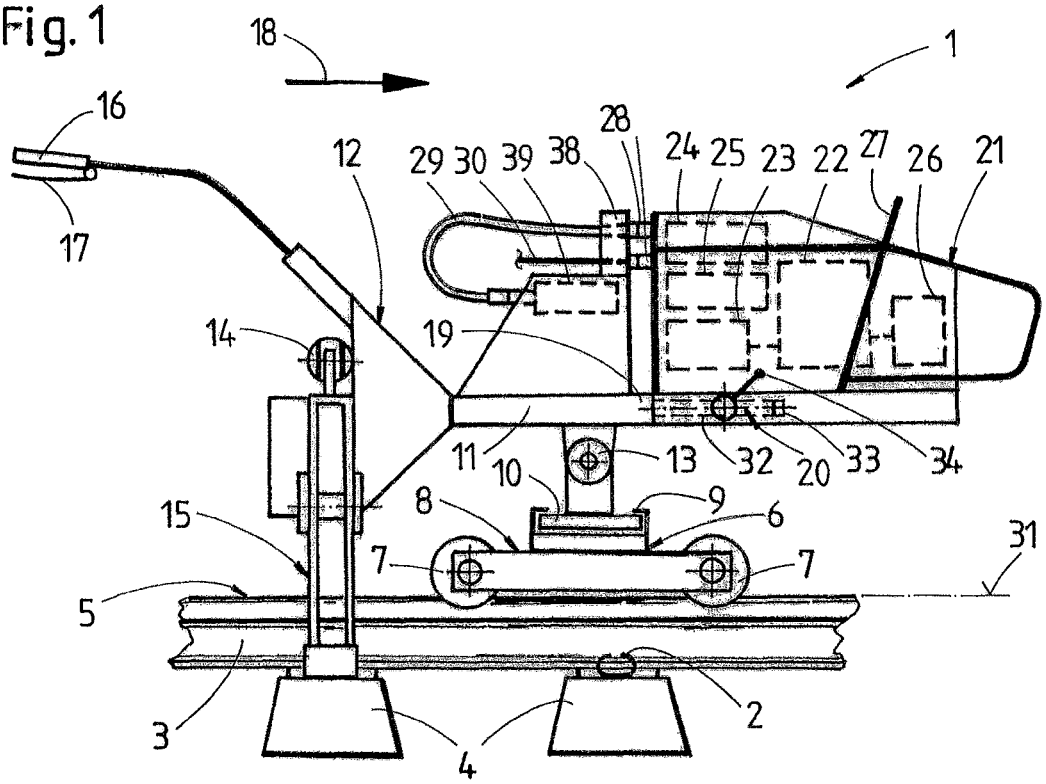
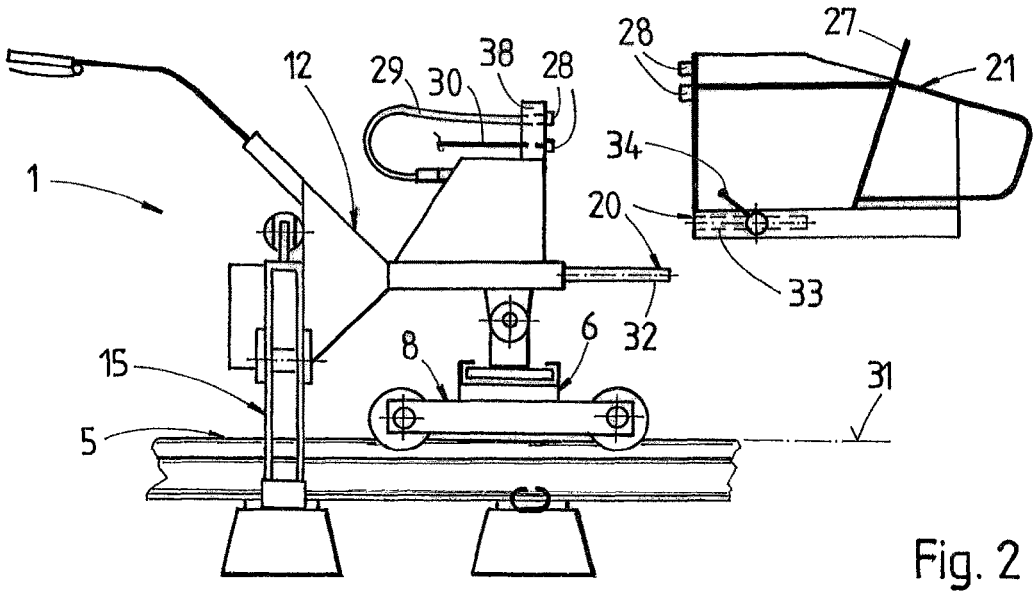
Fig. 2

Fig. 3
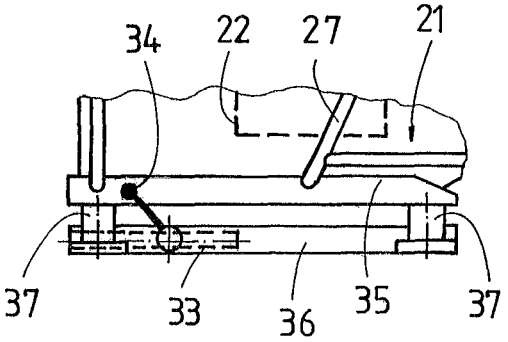
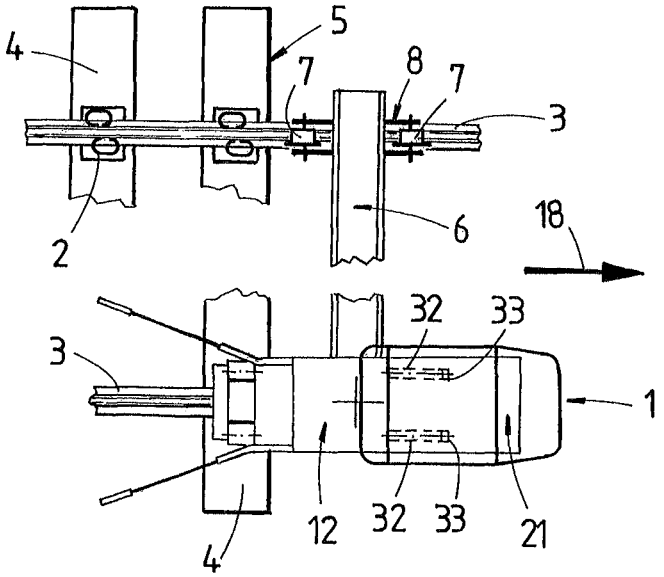
Fig. 4

MANUALLY DISPLACEABLE MACHINE FOR MAINTAINING A TRACK

CROSS REFERENCE TO RELATED APPLICATIONS

This application is the National Stage of PCT/EP2013/002212 filed on Jul. 25, 2013 which claims priority under 35 U.S.C. §119 of German Application No. 20 2012 007 818.6 filed on Aug. 16, 2012, the disclosures of which are incorporated by reference. The international application under PCT article 21(2) was not published in English.

The invention relates to a manually displaceable machine for track maintenance, consisting of a work unit having two hand grips and working tools designed to be actuated by drives, and a motor unit joined to the work unit and serving for energy supply, wherein the work- and motor unit is connected by means of an articulated connection to a chassis frame provided for riding on rails of a track and having flanged rollers.

A machine of this type is known from FR 2 659 674 or DE 20305569 U1, wherein the working tools are used for installing rail clips. During working operations, the machine is displaced on the track to the next sleeper by means of the hand grips. Since such machines are relatively heavy, the removal thereof from the track or the transferring to the track poses a physical burden on the operating personnel reaching the acceptable limits.

It is the object of the present invention to provide a machine of the type mentioned at the beginning with which a simplified transfer into the working position or removal from the track is made possible.

According to the invention, this object is achieved with a machine of the specified kind by way of the features cited in the characterizing part of the main claim.

Owing to these features, it is possible to transport the motor unit and the work unit separately and reconnect them to one another again very simply, as required, meaning a significant relief of physical strain for the operating personnel. In an advantageous manner, projecting parts of the coupling can be used as hand grips for transporting the work unit. Additionally, for versatile use, the motor unit can also be coupled as energy supply to different work units designed for various functions.

Additional advantages of the invention become apparent from the dependent claims and the drawing description.

The invention will be described in more detail below with reference to an embodiment represented in the drawing in which FIGS. 1 and 2 each show a side view of a machine for track maintenance, FIG. 3 shows an enlarged detail view, and FIG. 4 shows a top view of the machine.

A machine 1, shown in FIG. 1, is designed for installing rail clips 2 by means of which rails 3 and sleepers 4 of a track 5 are connected to one another. The machine 1 has a chassis frame 6 which is supported and able to roll on both rails 3 by means of a respective undercarriage 8 equipped with flanged rollers 7. A transverse guide 9 extending in the transverse direction of the track connects the two undercarriages 8 to one another and serves for the transversely displaceable support of a carriage 10.

Mounted on said carriage 10 is an assembly frame 11 of a work unit 12, said frame extending in the longitudinal direction of the track or rails and being designed to be rotatable or tiltable relative to the chassis frame 6 by means of an articulated connection 13 and to be positioned by means of the transverse guide 9 above one or the other rail 3 of the track 5, as desired (see FIG. 4).

The assembly frame 11 is connected at its one end, distanced from the articulated connection 13, to working tools 15 actuatable by drives 14 and to two hand grips 16 having control elements 17. A front end 19—with regard to a displacement direction 18 of the machine 1—of the work unit 12 is connected by means of a coupling 20 to a motor unit 21.

The motor unit 21 is composed of a motor 22, a hydraulic pump 23, a hydraulic tank 24, a cooler 25, and an electric generator 26 with an alternator and can be transported by means of hand grips 27 (see FIG. 2). Arranged between the motor- and work unit (21, 12) are line couplings 28 for releasable connection of hydraulic lines 29, provided for actuation of the drives 14, and of a motor control line 30.

The coupling 20 provided for connection of the motor- and work unit 21, 12 is formed, on the one hand, by two coupling pins 32, connected to the work unit 12 and extending parallel to one another and approximately parallel to a travelling plane 31 formed by the flanged rollers 7 or rails 3, and, on the other hand, by coupling sleeves 33 connected to the motor unit 21 and serving for housing the coupling pins 32, and also by a fixing device 34.

As visible in FIG. 3, the motor unit 21 has a first frame 35 connected to the motor 22, and a second frame 36 connected to the coupling sleeves 33. The two frames 35, 36, positioned one above the other, are connected to one another solely by damping elements 37.

The line couplings 28 are designed as a coupling block 38 connected, on the one hand, to the motor unit 21 and, on the other hand, to the work unit 12, for a coupling operation of the hydraulic- and motor control lines 29, 30 occurring automatically by pushing the motor unit 21 onto the coupling pins 32. A valve control 30 provided for controlling the working tools 15 is arranged on the work unit 12. Alternatively, instead of the automatic coupling, it would also be possible to carry out a coupling operation manually.

For working operations of the machine 1, the chassis frame 6 is first placed upon the rails 3. Subsequently, the work unit 12—by grabbing the hand grips 16, on the one hand, and the coupling pins 32, on the other hand—can be carried effortlessly and fixed onto the articulated connection 13. Finally, the motor unit 21 is gripped with the aid of the hand grips 27, pushed onto the coupling pins 32, and fixed by means of the fixing device 34. As a result of the pushing motion, the hydraulic- and motor control lines 29, 30 are coupled automatically, whereby the machine 1 is fully assembled and operational. The removal of the machine 1 from the track 5 can likewise be accomplished in three parts in that first the motor unit 21 is pulled from the coupling pins 32. In further sequence, the work unit 12 is separated from the chassis frame 6 and transported away.

The invention claimed is:

1. A manually displaceable machine (1) for track maintenance, consisting of a work unit (12) having two hand grips (16) and working tools (15) designed to be actuated by drives (14), and a motor unit (21) joined to the work unit (12) and serving for energy supply, wherein the work- and motor unit (12, 21) is connected by means of an articulated connection (13) to a chassis frame (6) provided for riding on rails (3) of a track (5) and having flanged rollers (7), characterized by the following features:

a) the motor unit (21) is equipped with hand grips (27) and connected to the work unit (12) by means of a detachable coupling (20);

b) the motor unit (21) is composed of a motor (22), a hydraulic pump (23), a hydraulic tank (24), a cooler (25), and an electric generator (26);

c) arranged between the motor- and work unit (21, 12) are line couplings (28) for detachable connection of hydraulic lines (29), provided for actuation of the working tools (15), and of a motor control line (30).

2. The machine according to claim 1, wherein the coupling (20) provided for connection of the motor- and work unit (21, 12) is formed, on the one hand, by two coupling pins (32), connected to the work unit (12) and extending parallel to one another and approximately parallel to a travelling plane (31) formed by the flanged rollers (7), and, on the other hand, by coupling sleeves (33) serving for housing said coupling pins (32) and connected to the motor unit (21), and by a fixing device (34).

3. The machine according to claim 1, wherein the motor unit (21) has a first frame (35) connected to the motor (22), and a second frame (36) connected to the coupling sleeves (33), wherein the two frames (35, 36) are connected to one another by damping elements (37).

4. The machine according to claim 1, wherein the line couplings (28) are designed as a coupling block (38) connected, on the one hand, to the motor unit (21) and, on the other hand, to the work unit (12), for an automatic coupling operation of the hydraulic- and motor control lines (29, 30) by pushing the motor unit (21) onto the coupling pins (32).

5. The machine according to claim 1, wherein a valve control (30) provided for controlling the working tools (15) is arranged on the work unit (12).

* * * * *